US006840389B2

(12) United States Patent
Chen

(10) Patent No.: US 6,840,389 B2
(45) Date of Patent: Jan. 11, 2005

(54) HANGER FOR WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 57 days.

(21) Appl. No.: 10/335,742

(22) Filed: Jan. 2, 2003

(65) Prior Publication Data

US 2004/0099621 A1 May 27, 2004

(30) Foreign Application Priority Data

Nov. 22, 2002 (TW) ..... 91219051 U

(51) Int. Cl.[7] ..... A47F 7/00; B65D 85/18

(52) U.S. Cl. ..... 211/70.6; 206/376; 206/349

(58) Field of Search ..... 211/70.6; 206/349, 206/376, 477, 377, 378, 495; 248/309.1, 222.51, 223.41, 224.7, 225.11, 225.12, 229.1, 229.12, 229.13, 229.14, 226.11, 311.2, 314, 317, 312

(56) References Cited

U.S. PATENT DOCUMENTS 3,081,056 A * 3/1963 Sweet et al. ..... 248/552
3,926,308 A 12/1975 Sullivan ..... 206/223
4,372,468 A * 2/1983 Harvey ..... 224/268
5,044,591 A * 9/1991 Huang ..... 248/317
5,322,256 A * 6/1994 Kanwischer ..... 248/312
5,335,772 A * 8/1994 Chervenak et al. ..... 206/349
5,713,467 A * 2/1998 Kao ..... 206/349
5,788,303 A * 8/1998 Chia-Hsiang ..... 294/143
5,941,386 A * 8/1999 Hu et al. ..... 206/376
6,193,200 B1 * 2/2001 Kao ..... 248/309.1
6,241,208 B1 * 6/2001 Lin ..... 248/309.1
6,378,700 B1 * 4/2002 Tong ..... 206/376
D473,049 S 4/2003 Devine ..... D3/228
2002/0175257 A1 * 11/2002 Yen ..... 248/309.1
2003/0141266 A1 * 7/2003 Lin ..... 211/70.6

* cited by examiner

*Primary Examiner*—Jennifer E. Novosad
(74) *Attorney, Agent, or Firm*—Alan D. Kamrath; Nikolai & Mersereau, P.A.

(57) ABSTRACT

A hanger for holding a wrench includes a board, a first holder and a second holder. The first holder includes an external side pivotally mounted on the board and an internal side defining a recess for receiving a portion of the wrench. The second holder includes an external side pivotally mounted on the board and an internal side defining a recess for holding another portion of the wrench. The first holder may include at least one protrusion formed on a rear face for abutment against a rear face of the second holder when the first holder is pivoted from the second holder to an extent, thus avoiding further pivoting. The second holder may include at least one protrusion formed on the rear face for abutment against the rear face of the first holder when the second holder is pivoted from the first holder to an extent, thus avoiding farther pivoting.

20 Claims, 6 Drawing Sheets

HANGER FOR WRENCH

BACKGROUND OF INVENTION

1. Field of Invention

The present invention relates to a hanger for a wrench.

2. Related Prior Art

Taiwan Patent Publication No. 319154 discloses a conventional hanger for wrenches each including a handle and a head. The hanger 10 includes a board 11 and a series of holders 14 formed on the board 11. Each of the holders 14 consists of two prongs extending from the board 11 towards each other, thus defining a space 15 between the prongs and a slit 16 between the tips of the prongs. To put a wrench into and from the space 15, a user has to pass the smallest dimension of the handle of the wrench through the slit 16. After putting the handle of the wrench in the space 15, the user has to rotate the wrench about its length so that the head of the wrench can be supported by means of the prongs. However, the user may exert an excessive force on the prongs each time he or she tries to mount the wrench on the holder or remove the wrench from the holder. The prongs may thus be damaged after the hanger is used for some time. When this happens, the wrench can be easily removed from the hanger since the slit 16 is enlarged.

The present invention is therefore intended to obviate or at least alleviate the problem encountered in the prior art.

SUMMARY OF INVENTION

Referring to FIGS. 1–6, according to the preferred embodiment of the present invention, a hanger for a wrench 4 includes a board 1 and two holders 2 and 3 pivotally mounted on the board 1 for holding the wrench 4 shown in FIGS. 4–6.

According to the present invention, a hanger for holding a wrench includes a board, a first holder and a second holder. The first holder includes an external side pivotally mounted on the board and an internal side defining a recess for receiving a portion of the wrench. The second holder includes an external side pivotally mounted on the board and an internal side defining a recess for holding another portion of the wrench.

In an aspect, the first holder includes at least one protrusion formed on a rear face for abutment against a rear face of the second holder when the first holder is pivoted from the second holder to an extent, thus avoiding further pivoting.

In another aspect, the second holder includes at least one protrusion formed on the rear face for abutment against the rear face of the first holder when the second holder is pivoted from the first holder to an extent, thus avoiding further pivoting.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF PREFERRED EMBODIMENT

Figure 1:
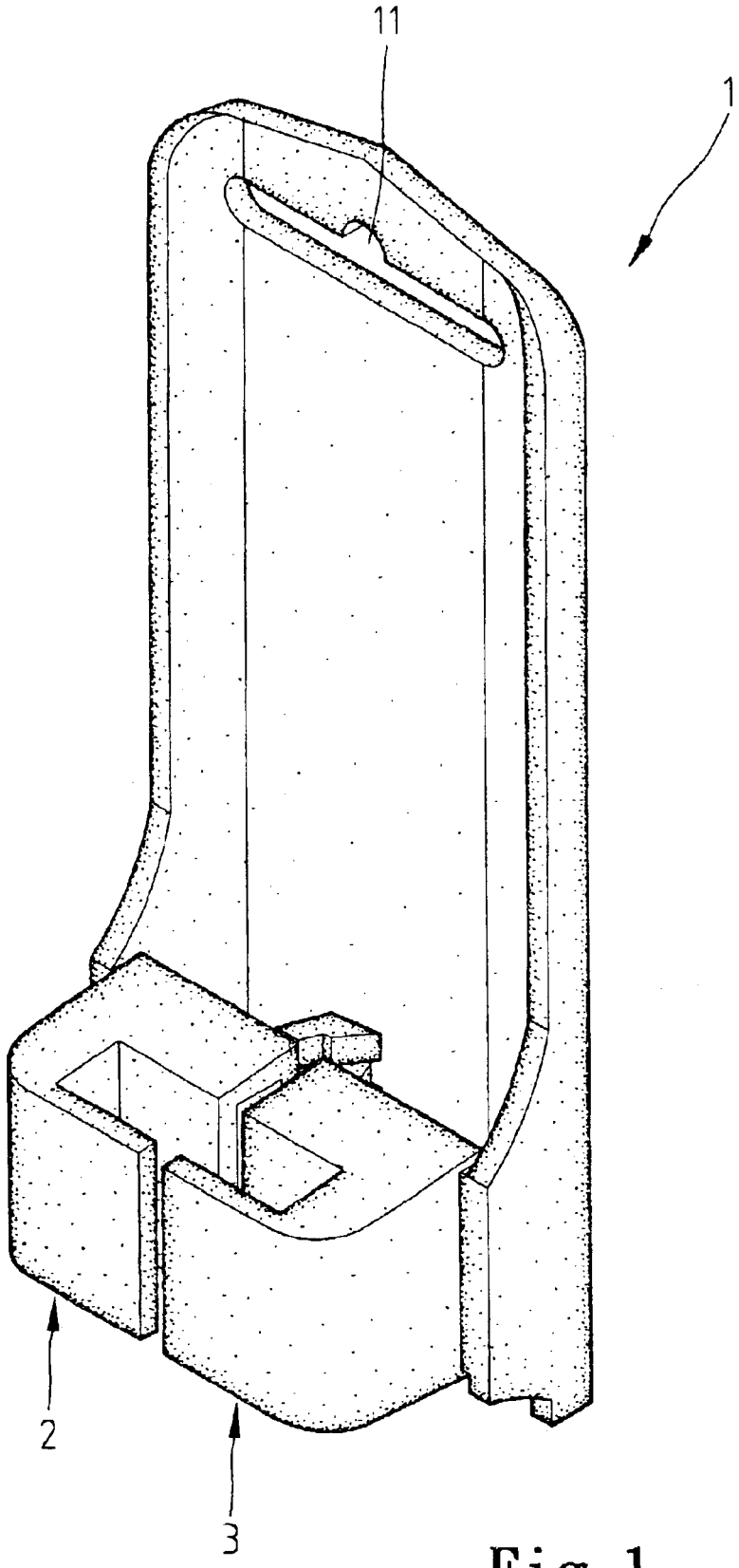
FIG. 1 is a perspective view of a hanger for a wrench according to the preferred embodiment of the present invention.
Figure 2:
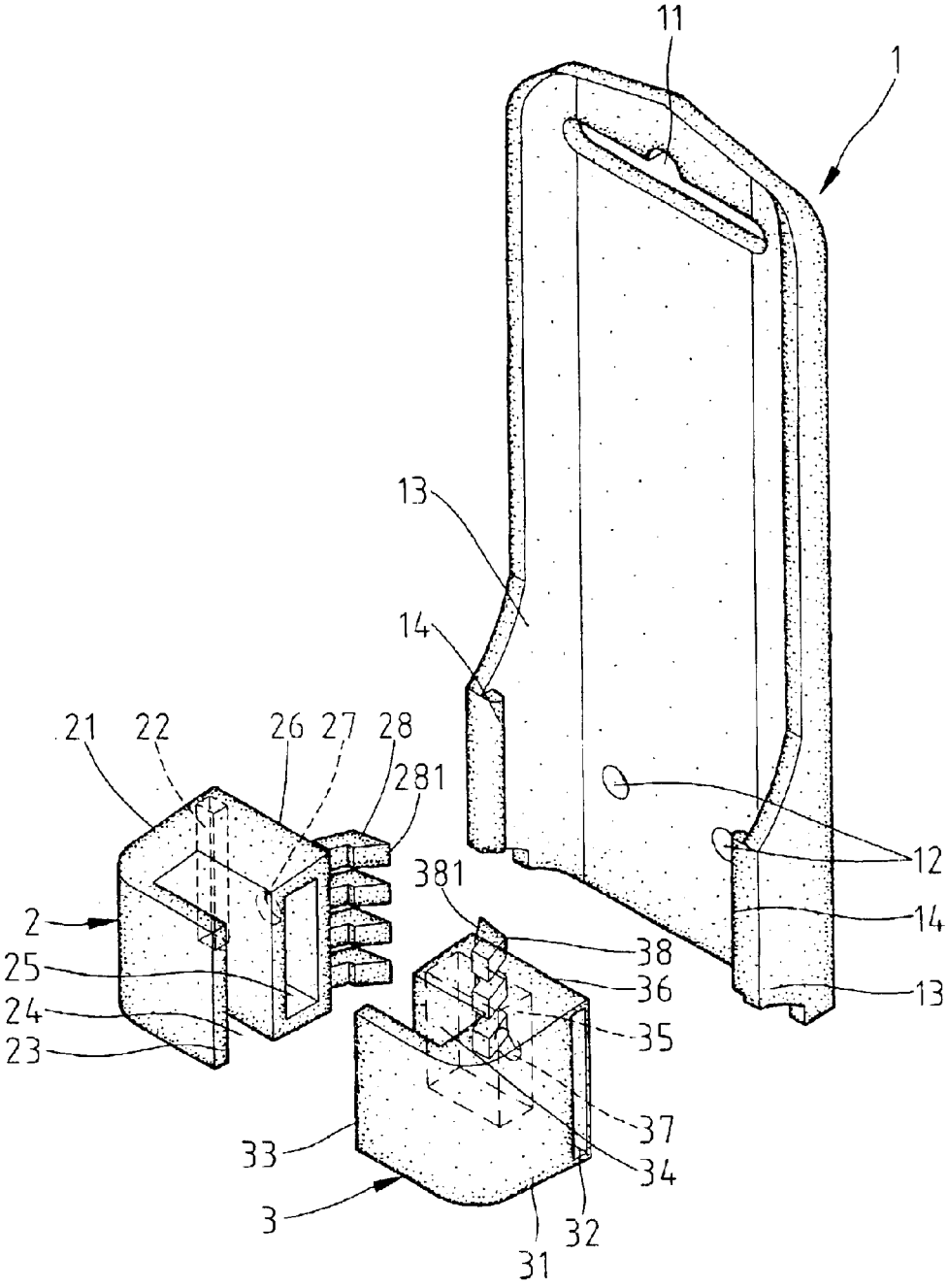
FIG. 2 is an exploded view of the hanger shown in FIG. 1.
Figure 3:
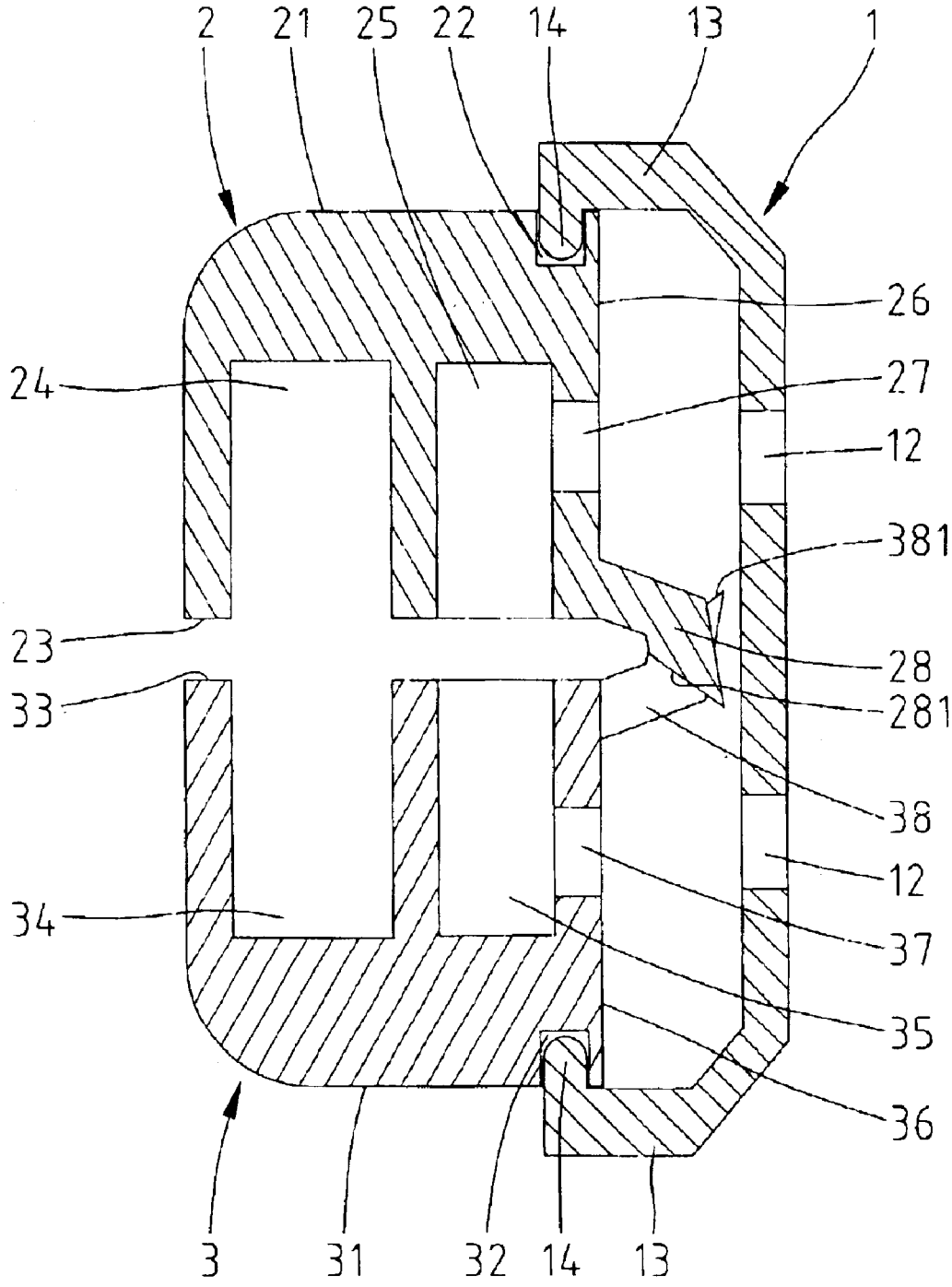
FIG. 3 is a cross-sectional view of the hanger shown in FIG. 1.
Figure 4:
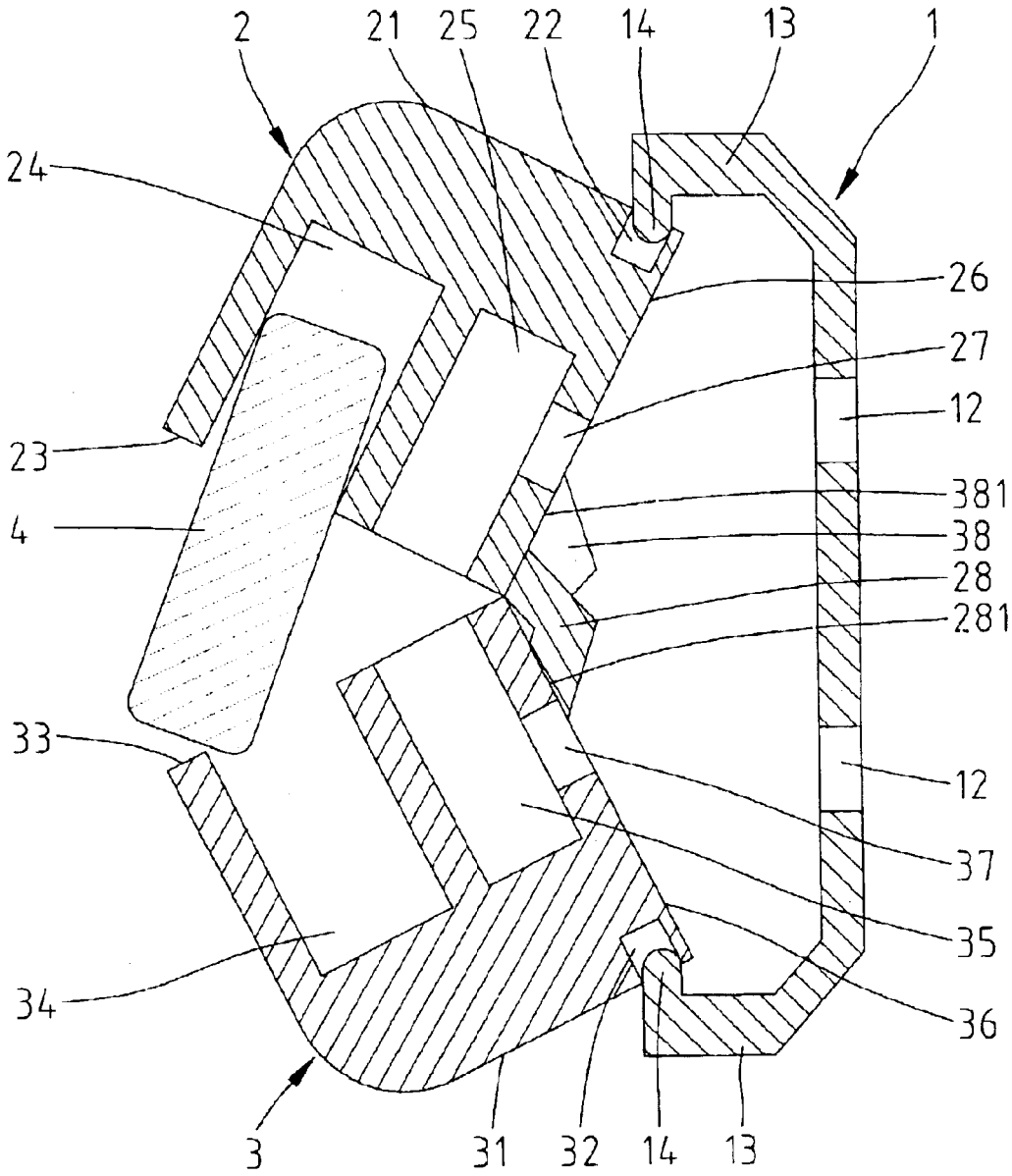
FIG. 4 is similar to FIG. 3 but showing the hanger in another position.
Figure 5:
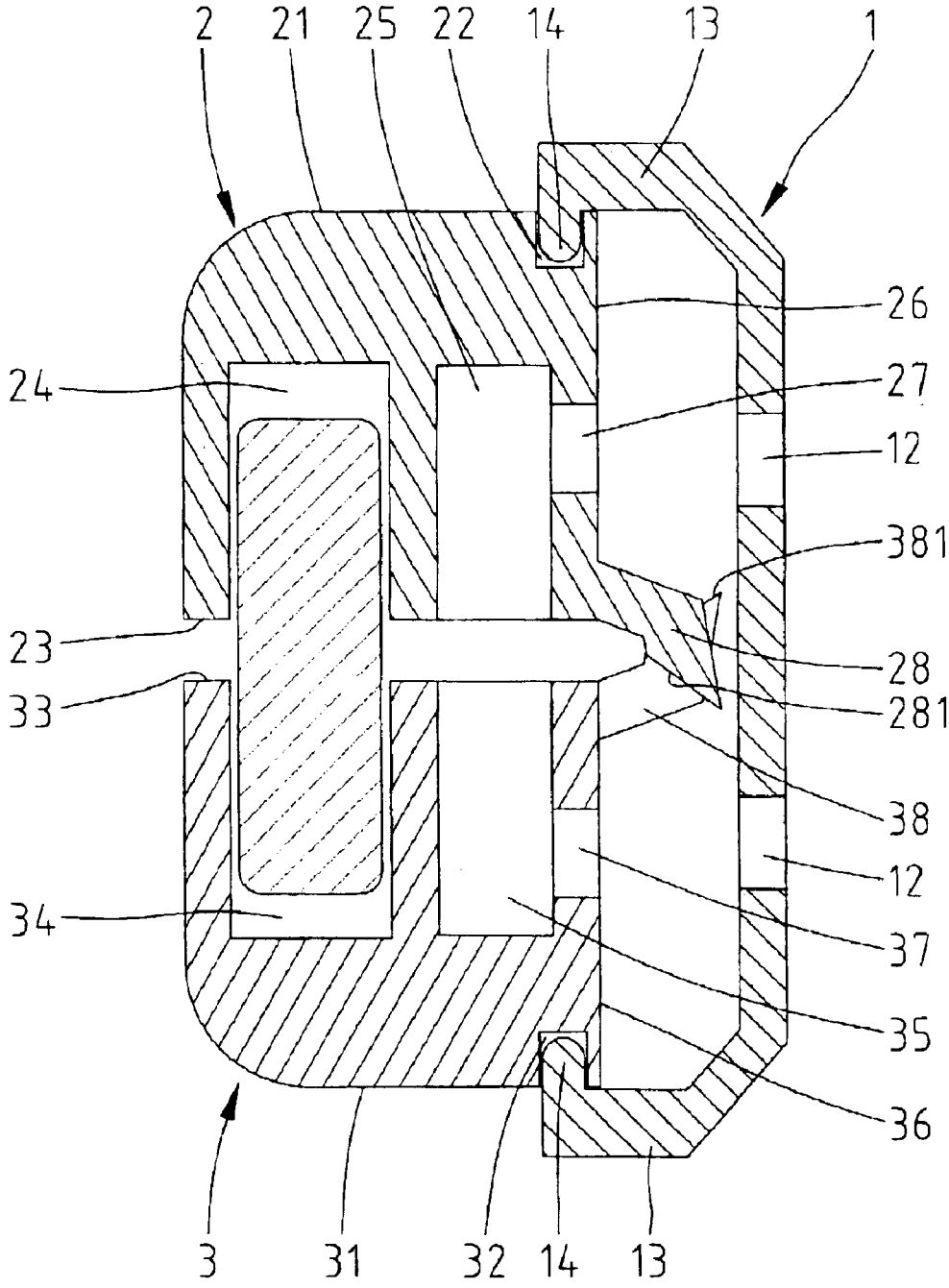
FIG. 5 is similar to FIG. 3 but showing the hanger holding a wrench.
Figure 6:
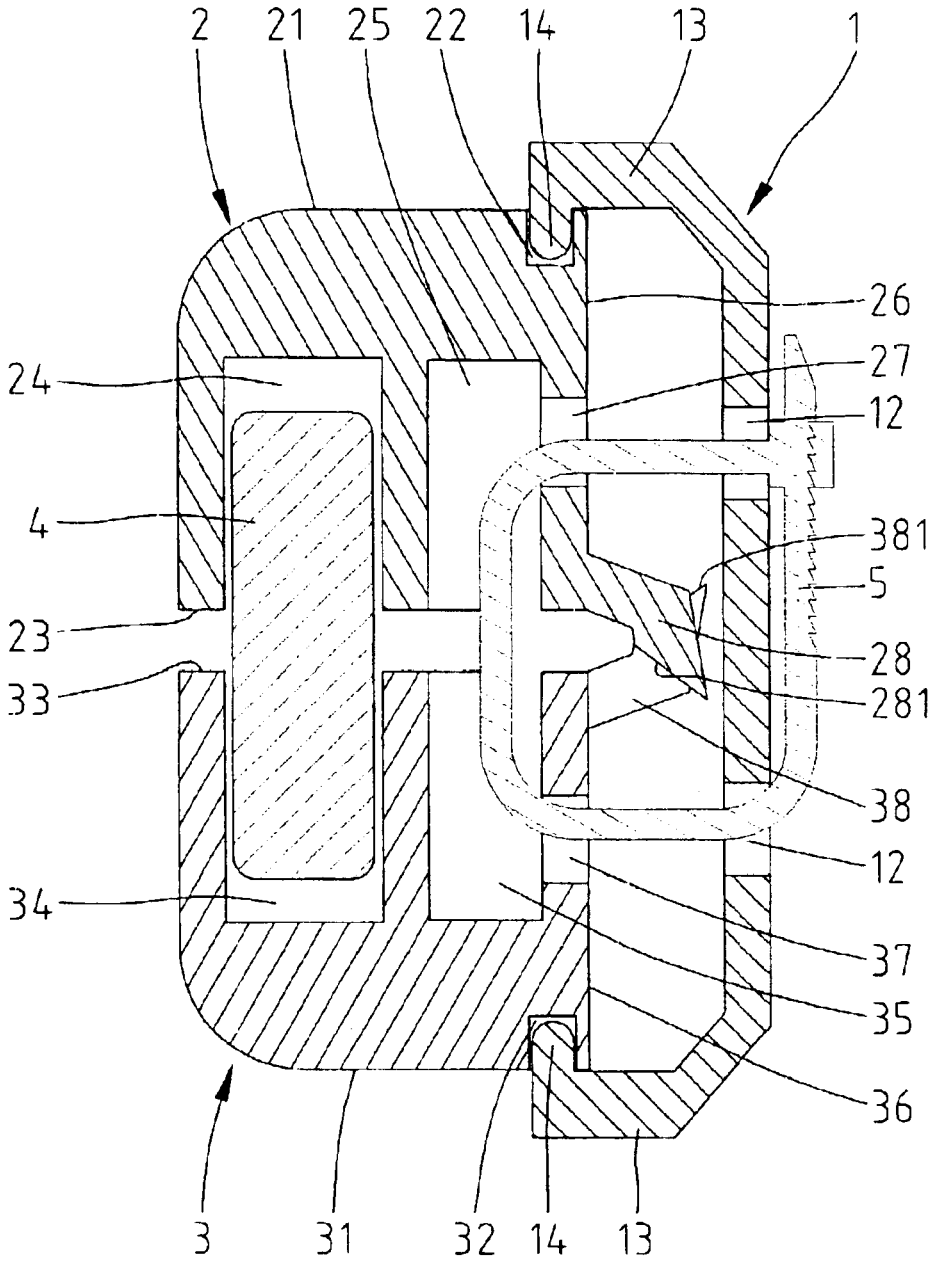
FIG. 6 is similar to FIG. 5 but showing the hanger used together with a strap.

Referring to FIGS. 1–6, according to the preferred embodiment of the present invention, a hanger for a wrench 4 includes a board 1 and two holders 2 and 3 pivotally mounted on the board 1 for holding the wrench 4 shown in FIGS. 4–6.

The board 1 includes a hole 11 defined therein for receiving a nail (not shown) secured to a wall (not shown), two holes 12 defined therein for receiving a strap 5, two fins 13 formed thereon and two shafts 14 each formed on one of the fins 13. Each of the shafts 14 includes a round periphery.

The holder 2 includes an external side 21, an internal side 23, a front face and a rear face 26. A recess 22 is defined in the external side 21 of the holder 2 in order to receive a first one of the shafts 14. The recess 22 includes two closed ends for receiving the first shaft 14. Two recesses 24 and 25 are defined in the internal side 23 of the holder 2. The recess 24 includes two open ends through which two ends of the wrench 4 can extend. The rear face 26 defines a hole 27 communicated with the recess 25. Four protrusions 28 are formed on the rear face 26.

The holder 3 includes an external side 31, an internal side 33, a front face and a rear face 36. The internal side 33 of the holder 3 faces the internal side 23 of the holder 2. A recess 32 is defined in the external side 31 of the holder 3 in order to receive a second one of the shafts 14. The recess 32 includes two closed ends for restricting the tips of the second shaft 14. Two recesses 34 and 35 are defined in the internal side 33 of the holder 3. The recess 34 includes two open ends through which two ends of the wrench 4 can extend. The rear face 36 defines a hole 37 communicated with the recess 35. Three protrusions 38 are formed on the rear face 36.

Referring to FIG. 3, the first shaft 14 is received in the recess 22, and the second shaft 14 is received in the recess 32. Thus, the holders 2 and 3 are pivotally mounted on the board 1. The protrusions 28 cross the protrusions 38. Referring to FIG. 4, the holders 2 and 3 are pivoted away from each other. When faces 281 of the protrusions 28 abut against the rear face 36 and faces 381 of the protrusions 38 abut against the rear face 26, the holders 2 and 3 cannot be further pivoted away from each other. A user can put the wrench 4 in the recesses 24 and 34. Then, the user can push the wrench 4 towards the board 1. Thus, the holders 2 and 3 can be pivoted towards each other, i.e., the holders 2 and 3 are closed as shown in FIG. 5.

Referring to FIG. 6, a strap 5 can be inserted through the holes 27 and 37 and the recesses 25 and 35 so as to lock the holders 2 and 3. Thus,the wrench 4 cannot be removed from the hanger unless the strap 5 is cut.

The present invention has been described via illustration of the preferred embodiment. After a study of this specification, those skilled in the art can derive various variations from the preferred embodiment. Therefore, the preferred embodiment is only taken as an example and shall not limit the scope of the present invention defined in the following claims.

What is claimed is:

1. A hanger for holding a wrench, the hanger including:

a board;

a first holder including an external side pivotally mounted on the board and an internal side defining a recess for receiving a portion of the wrench; and a second holder including an external side pivotally mounted on the board and an internal side defining a recess for holding another portion of the wrench, wherein the board includes two fins formed thereon and two shafts each formed on one of the fins, and each of the first and second holders includes a recess defined in the external side in order to receive one of the shafts.

2. The hanger according to claim 1 wherein the board includes a hole defined therein for receiving a nail secured to a wall.

3. The hanger according to claim 1 wherein each of the shafts includes a round periphery.

4. The hanger according to claim 1 including a strap for locking the first and second holders in a closed position.

5. The hanger according to claim 4 wherein the strap is formed of cutable material so that the wrench cannot be removed from the hanger unless the strap is cut.

6. A hanger for holding a wrench, the hanger including:

a board;

a first holder including an external side pivotally mounted on the board and an internal side defining a recess for receiving a portion of the wrench; and a second holder including an external side pivotally mounted on the board and an internal side defining a recess for holding another portion of the wrench, wherein the first holder includes a plurality of protrusions, and the second holder includes a plurality of protrusions alternately arranged with the protrusions of the first holder.

7. The hanger according to claim 6 wherein the board includes a hole defined therein for receiving a nail secured to a wall.

8. The hanger according to claim 6 including a strap for locking the first and second holders in a closed position.

9. The hanger according to claim 8 wherein the strap is formed of cutable material so that the wrench cannot be removed from the hanger unless the strap is cut.

10. A hanger for holding a wrench, the hanger including:

a board;

a first holder including an external side pivotally mounted on the board and an internal side defining a recess for receiving a portion of the wrench;

a second holder including an external side pivotally mounted on the board and an internal side defining a recess for holding another portion of the wrench; and a strap for locking the first and second holders in a closed position, wherein each of the first and second holders includes a second recess defined in the internal side thereof and a hole defined in the rear face, and the strap is inserted through the hole defined in a rear face of each of the first and second holders and the second recess defined in the internal side of each of the first and second holders.

11. The hanger according to claim 10 wherein the board defines two holes through which the strap is inserted.

12. The hanger according to claim 10 wherein the board includes a hole defined therein for receiving a nail secured to a wall.

13. The hanger according to claim 10 including a strap for locking the first and second holders in a closed position.

14. The hanger according to claim 13 wherein the strap is formed of cutable material so that the wrench cannot be removed from the hanger unless the strap is cut.

15. A hanger for holding a wrench, the hanger including:

a board;

a first holder including an external side pivotally mounted on the board and an internal side defining a recess for receiving a portion of the wrench; and a second holder including an external side pivotally mounted on the board and an internal side defining a recess for holding another portion of the wrench, wherein the first holder includes at least one protrusion formed on a rear face for abutment against a rear face of the second holder when the first holder is pivoted from the second holder to an extent, thus avoiding further.

16. The hanger according to claim 15 wherein the board includes a hole defined therein for receiving a nail secured to a wall.

17. The hanger according to claim 15 including a strap for locking the first and second holders in a closed position.

18. The hanger according to claim 17 wherein the strap is formed of cutable material so that the wrench cannot be removed from the hanger unless the strap is cut.

19. A hanger for holding a wrench, the hanger including:

a board;

a first holder including an external side pivotally mounted on the board and an internal side defining a recess for receiving a portion of the wrench; and a second holder including an external side pivotally mounted on the board and an internal side defining a recess for holding another portion of the wrench, wherein the second holder includes at least one protrusion formed on a rear face for abutment against a rear face of the first holder when the second holder is pivoted from the first holder to an extent, thus avoiding further pivoting.

20. The hanger according to claim 19 wherein the board includes a hole defined therein for receiving a nail secured to a wall.

* * * * *